United States Patent [19]

Hruby, Jr.

[11] 4,055,301

[45] Oct. 25, 1977

[54] SHOWER HEAD WITH DIVERGENT IMPACT EFFECT NOZZLE

[75] Inventor: John O. Hruby, Jr., Burbank, Calif.

[73] Assignee: Rain Jet Corporation, Burbank, Calif.

[21] Appl. No.: 706,465

[22] Filed: July 19, 1976

[51] Int. Cl.[2] ..... B05B 1/08; B05B 1/16

[52] U.S. Cl. ..... 239/101; 239/394

[58] Field of Search ..... 239/DIG. 16, 17, 101, 239/102, 390–392, 394, 396, 428.5, 437, 443, 498–500, 553.3, 589, 590, 590.5

[56] References Cited

U.S. PATENT DOCUMENTS

| | | | |
|---|---|---|---|
| 630,468 | 8/1899 | Quayle | 239/394 X |
| 2,670,942 | 3/1954 | Aghnides | 239/391 |
| 2,793,016 | 5/1957 | Aghnides | 239/391 |
| 2,974,877 | 3/1961 | Hruby, Jr. | 239/237 |
| 3,684,176 | 8/1972 | Hruby, Jr. | 239/101 |
| 3,791,584 | 2/1974 | Drew et al. | 239/237 |

*Primary Examiner*—Robert W. Saifer

*Attorney, Agent, or Firm*—Christie, Parker & Hale

[57] ABSTRACT

An adjustable shower head is defined so that in one operating state thereof, the discharge from the shower head, upon contact with the body of a user, produces a massage-like effect. The shower head includes a body which defines therein a cavity and which has a front face defining an opening therein. Means are coupled to a rear portion of the body to adapt the body to be connected to a source of water for flow of water from the source to the cavity. A nozzle is disposed in the cavity with a discharge end thereof mounted in alignment with the opening fo discharge of water from the cavity only through the nozzle. The nozzle has no moving parts and is arranged to produce a randomly directionally unstable discharge characteristic in water discharged therefrom during use of the shower head. Modulatng means are mounted to the body and are operable by a user of the shower head for modulating the effective force for water discharged by the nozzle.

14 Claims, 11 Drawing Figures

Fig. 8
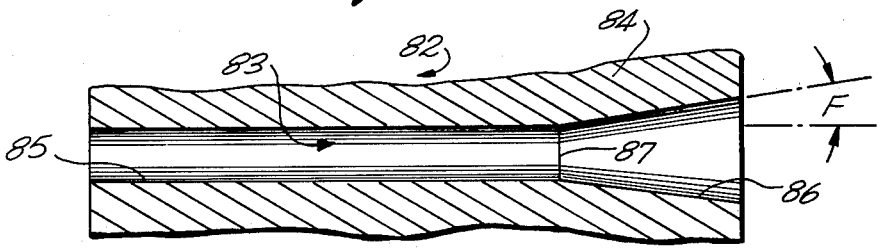
Fig. 9
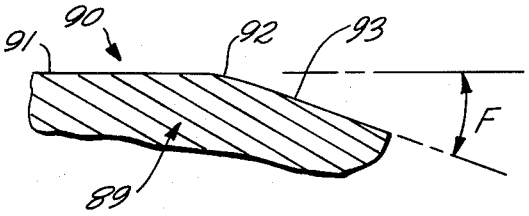
Fig. 10
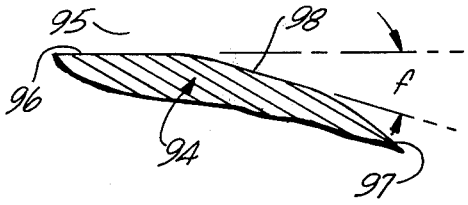
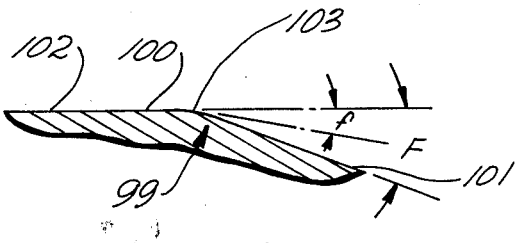
Fig. 11

SHOWER HEAD WITH DIVERGENT IMPACT EFFECT NOZZLE

FIELD OF THE INVENTION

This invention pertains generally to shower heads and, more particularly, to a shower head which has no moving parts and which is arranged, in one of several operative adjusted states thereof, for producing a discharged water stream which has a massage-like effect upon contact with the body of a user.

REFERENCE TO RELATED APPLICATIONS

The subject matter of my concurrently filed patent applications, Ser. Nos. 706,466 and 706,464, are related to the present invention. Preferably, a shower head according to the present invention includes nozzles of the type described in my concurrently filed application Ser. No. 706,466, and more preferably nozzles of the type described in my concurrently filed application Ser. No. 706,464.

BACKGROUND OF THE INVENTION

Review of the Prior Art

U.S. Pat. Nos. 2,974,877 and 3,791,584 are owned by the assignee of this invention (Rain Jet Corp. of Burbank, Calif.) and describe adjustable shower heads which, in one state of adjustment thereof, produce a discharged water pattern of such a character that when the discharged water contacts the body of a user, a massage-like effect is sensed. (Shower heads according to the latter patent are manufactured and sold by Rain Jet Corp. under its model number RMS 200.) A brief examination of these prior patents will show that the structures of the shower heads described therein are relatively complicated and include moving parts. Because of the relative complexity of these prior shower heads, they are relatively expensive to manufacture and this fact is reflected in the ultimate selling price of the product. Also, because of their use of moving parts, these prior shower heads are sensitive to and gradually adversely affected by dissolved minerals and particulate matter, such as sand, in the water supplied to them; these gradual adverse effects are easily remediable by the user, but even infrequent need for service of the shower head by the user, who normally is unsophisticated and unappreciative of the complexities and unique advantages of the product, is an inconvenience.

The shower heads described in the two patents cited above produce unique discharge characteristics which have resulted in significant commercial success and user acceptance of these products. Because of the cost inherent in the manufacture of the prior shower heads, they are not directly competitive in the marketplace with other shower heads of more conventional design which do not produce the same unique discharge characteristics.

A need exists in the marketplace for a shower head which is of simple design productive of reduced manufacturing costs, and yet which provides discharge effects similar to the discharge effects obtainable by the shower heads constructed in accord with U.S. Pat. Nos. 2,974,877 and 3,791,584. Optimally, a lower cost shower head of this character has no moving parts other than the discharge modifying mechanism thereof, includes a minimum of machined components, and is simple to assemble.

SUMMARY OF THE INVENTION

This invention provides a shower head which fills the need identified above. The present shower head operates to provide a plurality of different discharge characteristics which are similar to the various discharge characteristics of a shower head constructed in accord with U.S. Pat. No. 3,791,584, for example. The present shower head has no moving parts, is simple to assemble, and contains a minimum number of machined components; it is substantially less expensive to manufacture than the prior shower heads described in the aforementioned patents. Also, the present shower head does not contain any precisely defined orifices or water flow openings within its structure, and is therefore essentially insensitive to adverse effects by hard water or by the presence of sand or other sediments in water introduced to the shower head. As will be seen from the following detailed description, the present shower head is simple, efficient, economic to manufacture and reliable; it is a product which effectively complements the prior shower head described in U.S. Pat. No. 3,791,584, for example.

Generally speaking, the present shower head includes a body which defines a cavity and which has a front face defining an opening therein to the cavity. Means are coupled to a rear portion of the body to adapt the body to be connected to a source of water for flow of water from the source into the cavity. A nozzle is disposed in the cavity with a discharge end thereof mounted in alignment with the opening for discharge of water from the cavity only through the nozzle. The nozzle has no moving parts and is arranged to produce a randomly directionally unstable discharge characteristic in water discharged therefrom during use. Modulating means are mounted to the body and are operable by a user of the shower head for modulating the effective force of water discharged by the nozzle.

Preferably, the nozzle which is included in the shower head according to the present invention is a nozzle defined in accordance with the descriptions of my copending applications, Ser. Nos. 706,464 and 706,466, both of which were filed on the same day as the present patent application, and both of which are assigned to the assignee of this invention. In order that the following description of the present shower head may be directed more precisely and directly to those aspects of the present invention which are different from the subject matter described in my other concurrently filed applications, and yet provide a full explanation of the present shower head, certain portions of the concurrently filed applications are incorporated herein by reference.

DESCRIPTION OF THE DRAWINGS

The above-mentioned and other features of this invention are more fully set forth in the following detailed description of presently preferred embodiments of this invention, which description is presented with reference to the accompanying drawings, in which:

FIG. 8 is a fragmentary enlarged cross-sectional elevation view of an outlet duct arrangement useful in a nozzle of this invention;

FIG. 9 is a fragmentary cross-section view of another outlet duct configuration;

FIG. 10 is a fragmentary cross-section view of still another outlet duct configuration; and FIG. 11 is a fragmentary cross-section view of yet another outlet duct configuration.

INCORPORATION BY REFERENCE

Figure 2:
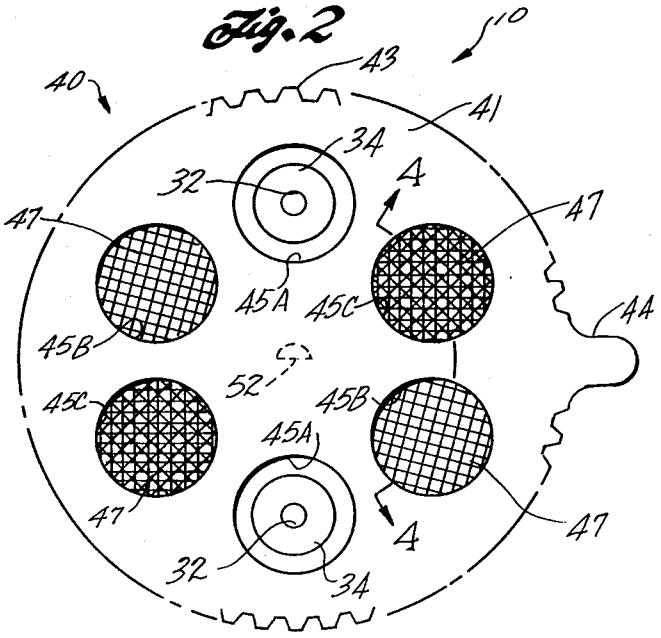
FIG. 2 is a front elevation view of the shower head shown in FIG. 1.

There is incorporated herein by reference, as though fully set forth at this point, that portion of my concurrently filed application Ser. No. 706,466, which begins at page 10, line 14, and which ends at page 24, line 22. There is also incorporated herein by reference, as though fully set forth at this point, that portion of my concurrently filed application Ser. No. 706,464, which begins at page 11, line 6, and which ends at page 18, line 24.

DESCRIPTION OF THE ILLUSTRATED EMBODIMENTS

For an understanding of this invention in the context of the prior art, it is important to bear in mind the distinction between liquids, on the one hand, and gases, on the other hand, as opposed to the overall generic descriptive term "fluid" which is sufficiently broad to apply to both gases and liquids. This invention is concerned with liquid discharge nozzles and devices. It is not concerned with nozzles or other structures for discharging or dispensing gases or mixtures of gases and liquids. In the context of liquid discharge nozzles, this invention is concerned with the production of a particular discharge characteristic in which, for a given condition of applied liquid flow rate and pressure, the quantity of liquid discharged does not vary from time to time but which manifests a randomly directionally unstable discharge pattern. That is, a nozzle of the type used in the present shower head is of the type in which the instantaneous trajectory of the principal quantity of liquid discharged from the nozzle varies randomly in angular orientation relative to the axis of the outlet duct of the nozzle, and in which the instantaneous line of principal discharge is always within an encompassing envelope of generally conical configuration defined by the nozzle structure itself. In the context of the present invention, the liquid discharged from the nozzle is water and, beginning at a relatively low applied pressure of, say, 3–5 psig or less and through a wide range of pressures, the discharge pattern is so defined that at any given instant, the direction of movement of the principal portion of the liquid discharged from the nozzle is randomly indeterminate but lies along a line within an enveloping cone. There is generally, at any given instant, some discharge along all potential discharge lines within the enveloping cone; the principal portion of the discharge is predominantly along one line whose relationship angularly to the axis of the outlet duct varies at a characteristic frequency which is defined principally by the geometry and proportioning of the outlet duct from the nozzle, rather than by the applied liquid pressure.

Figure 1:
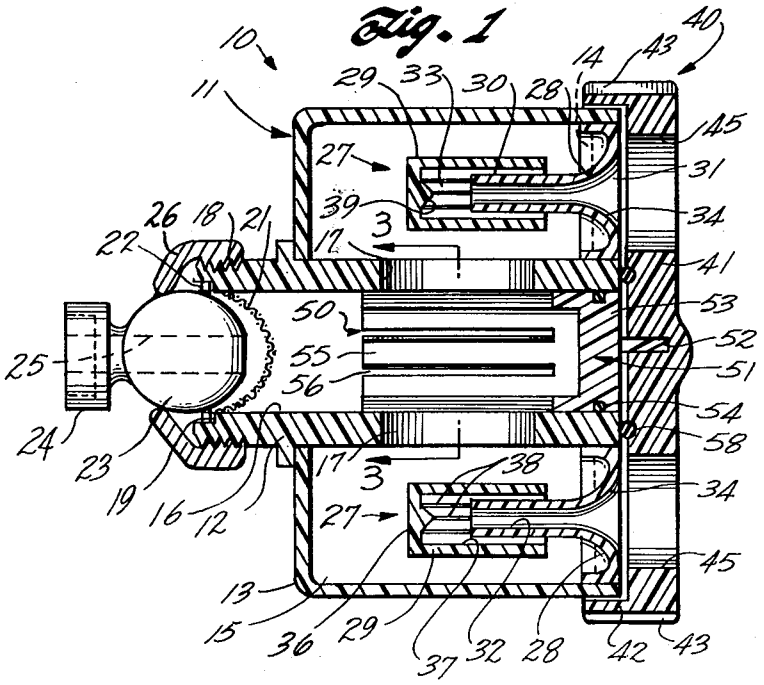
FIG. 1 is a cross-sectional elevation view of a multi-nozzle shower head.
Figure 5:
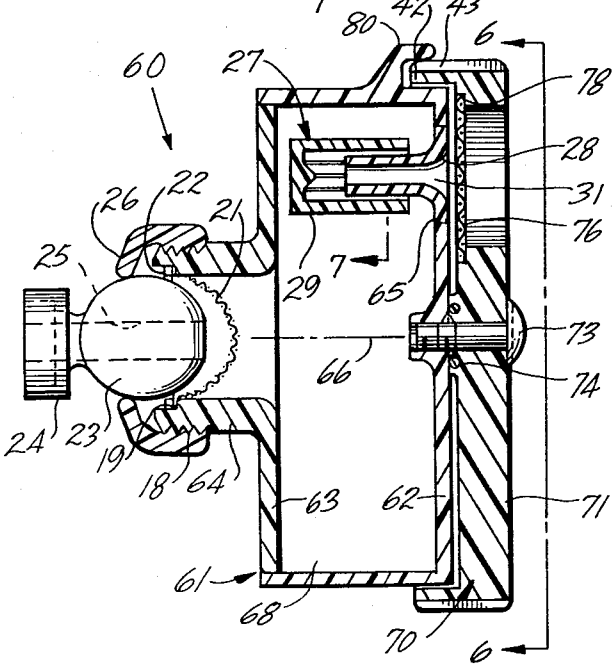
FIG. 5 is a cross-sectional elevation view of a single nozzle shower head.

FIGS. 1 and 5 of the accompanying drawings are longitudinal cross-sectional elevation views of a dual nozzle shower head 10 (FIG. 1) and of a single nozzle shower head 60 (FIG. 5). The single nozzle shower head shown in FIG. 5 is the presently preferred shower head according to this invention. The single nozzle shower head is preferred over the dual nozzle shower head in view of its greater simplicity and ease of manufacture, which advantages will be readily apparent from the following description in which the dual nozzle shower head 10 is first described.

Dual nozzle shower head 10 includes a body 11 which is composed of a central barrel 12, a concentric shell 13, and a front plate 14. The barrel extends rearwardly through the rear end of shell 13 and is connected to the shell in a watertight manner. Also, front plate 14 is annular and is sealed at its inner diameter to the outer diameter of the barrel, and at its outer diameter to the inner diameter of the shell, in a watertight manner. Accordingly, an annular cavity 15 is defined within the shell circumferentially of the barrel.

A circular bore 16 extends axially from end to end of the barrel. As shown best in FIG. 3, a pair of diametrically opposed elongate slots, aligned with the length of the barrel, are formed through the barrel to provide water flow communication from bore 16 to cavity 15.

The rear end of barrel 12 defines external screw threads 18 and a rearwardly facing shoulder 19 circumferentially of bore 16. A cup-like wire mesh strainer 21 has its rim mated with shoulder 19, and a suitable annular gasket 22 is mated with the rearwardly facing surface of the strainer rim for cooperation with a socket ball 23. The socket ball has an internally threaded boss 24 integral therewith for receiving an externally threaded water supply pipe or the like. The ball has an axial bore 25 for flow of water from the supply pipe through the ball into the shower head. An internally threaded socket nut 26 is engaged with the body 18 and to urge the ball into contact with gasket 22. Strainer screen 21 serves to capture any large particles of solid matter which may be present in water flowing through the socket ball to the shower head.

A pair of nozzle assemblies 27 are disposed in cavity 15 at diametrically opposed locations in body 11 for receiving water from cavity 15 and for discharging the water to the exterior of the shower head. The nozzle assemblies are mounted in a watertight manner in a corresponding hole (not shown) formed through the front plate 14 of body 11. Nozzle assemblies 27 are of the type which produce a randomly directionally unstable discharge characteristic during operation, which discharge characteristic has an impact effect of a massage-like nature on contact with the body of a user of the shower head. Each nozzle assembly may be in accord with the detailed descriptions of my concurrently filed patent application, Ser. No. 706,466, but it is preferred that each nozzle assembly be constructed in accord with the detailed descriptions of my concurrently filed application Ser. No. 706,464; the latter nozzles are of shorter axial extent and result in a more compact shower head. The nozzle assemblies 27 shown in FIGS. 1 and 5 are in accord with disclosures of my concurrently filed application Ser. No. 706,464. Those portions of the detailed description of my concurrently filed applications which are incorporated herein by reference set forth in detail the structural properties and relationships of those aspects of the respective nozzle assemblies which cooperate to provide a desired randomly directionally unstable discharge characteristic in water discharged from the nozzles during operation.

As shown in FIG. 1, each nozzle assembly 27 is composed of an outlet member 28 and a flow reversing cap member 29. The nozzle outlet member has a neck portion 30 which extends partially into the cap member for supporting the cap member in shower head cavity 15. The nozzle outlet member defines an outlet duct 31 which has a straight constant diameter throat 32 which opens directly from a chamber 33 defined within the cap immediately rearwardly of the rear end of the outlet member neck portion. The outlet duct 31 of each nozzle assembly 27 also has a flared portion 34 in which the flare is preferably of an arcuate nature but which, if desired, may be of a linear nature. The flared portion 34 of each nozzle outlet duct has the same diameter at its rear inlet end as the diameter of the outlet duct throat.

Preferably, as where the nozzle assembly is in accord with the descriptions of my concurrently filed application Ser. No. 706,464, the throat of the nozzle outlet duct has a ratio of length to diameter in the range of from about $\frac{1}{3}$ to about 18, but more preferably within a range from about 1 to about 4 in order that the nozzle assembly may be reduced in overall length. On the other hand, where an uncapped nozzle assembly of the type shown and described in my concurrently filed application Ser. No. 706,466 is used, the ratio of length to diameter of the outlet duct throat is in the range from about 4 to about 18.

Regardless of whether the nozzle assembly is of the capped or uncapped variety, the natures of the flared portion of the outlet duct and of its cooperation with the constant diameter throat of the outlet duct are the same. These relationships are described more fully in those portions of my concurrently filed applications which are incorporated by reference herein. For the purposes of this invention which resides in the overall shower head, however, the ultimate flare angle of the flared portion of the nozzle outlet duct, as measured relative to the axis of the duct throat, can be either (a) in the range of from about 2° to 6°, or (b) greater than 6°. If the flare angle of the duct flared portion is in the range of from about 2° to 6°, the flare geometry can be but is not required to be linear, i.e., conical, and coupled direct to the outlet end of the nozzle throat 32, so that the minimum diameter of the outlet duct in the flared portion thereof is equal to the outlet duct throat diameter. On the other hand, the flare angle of the duct flared portion can be greater than 6° if the flared portion 34 of the outlet duct is coupled to the duct throat 32 by a flared transition section in which the transition flare, if of a linear nature, is in the range from $\frac{1}{2}$° to 6°, or, if of a non-linear or arcuate nature (as shown in FIG. 1), is smoothly blended into the constant diameter throat portion.

The general rule which I have discovered concerning ultimate flare angles of more or less than 6° at the outlet end of a nozzle outlet duct, has been stated above. The applications of this rule are illustrated in FIGS. 8–11. An outlet duct 83 for a nozzle 82, useful in the practice of this invention, is shown in FIG. 8. Outlet duct 83 is defined in a suitable plug or other member 84. The outlet duct has a first straight constant diameter throat portion 85 having a ratio of length to diameter in the range of about $\frac{1}{3}$ to about 18 as described above. Duct 83 has a linearly flared second portion 86 in which the flare angle F, measured as shown, is no greater than 6° but not less than 2°. The duct flared and straight portions 86 and 85 connect at a discontinuity 87 at the outlet end of the straight throat at which the diameters of duct portions 85 and 86 are equal.

Another nozzle 89 (FIG. 9) has an outlet duct 90 formed in a member to have a straight throat portion 91, a linearly flared second portion 93, and a transition section 92 between portions 91 and 93. The length-to-diameter ratio of the throat is in the range given above. Flare angle F of duct second portion 93 is greater than 6° and may be in the range of from 10° to about 30°. Because angle F is greater than 6°, transition section 92 is provided directly between the duct throat and second portions. In transition section 92 the duct diameter increases non-linearly from that of the throat in such a way that at its outlet end the transition section becomes smoothly continuous with the inlet end of the duct second portion. I prefer that the cumulative length along the outlet duct axis of transition section 92 and second portion 93 is at least about two times the diameter of the duct throat portion; I prefer to observe this relationship in any nozzle according to this invention in which a transition section is used to give an ultimate flare angle F greater than 6°.

FIG. 10 shows a nozzle member 94 defining an outlet duct 95 having a straight throat 96, and arcuately curving flared second portion 97, and a linearly flared transition section 98, between the throat and second portions. The ultimate flare angle of the duct second portion is greater than 6° where, as in nozzle 94, the transition section is linearly flared. The transition flare angle *f* is in the range of from $\frac{1}{2}$° to 6°.

FIG. 11 shows another nozzle 99 in which the outlet duct 100 has a linearly flared second portion 101 connected to the constant diameter throat 102 by a short linear transition section 103, the flare angle F of the second portion being greater than 6°. FIG. 11 shows that the length of the transition section along the outlet duct can be very short, even on the order of a few thousandths of an inch. The flare angle *f* of transition section 103 is in the range of from $\frac{1}{2}$° to 6°.

The presently preferred nozzle for use in a single nozzle shower head 60 has a throat diameter of 0.172 inch, a throat length of 0.600 inch, an arcuate flare in which the radius of curvature of the flare is 3 inches, and the ultimate flare angle at the extreme outlet end of the outlet duct is 10° as measured relative to the axis of the nozzle throat; the arcuate flare of the outlet duct is defined so that the 3-inch radius of curvature of the flare is tangent to the throat walls at the outlet end of the throat. The preferred nozzle for a dual nozzle head 10 is identical except that the throat diameter is 0.125 inch.

Nozzle cap 29 is closed at its rear end by a wall 36 at the rear end of chamber 33. As shown best in FIG. 7, the chamber is defined by the combination of an axial bore and by a plurality of flute grooves 37 formed in the walls of the bore at uniformly spaced locations around the circumference of the cap bore. The bore and the flute grooves extend from the cap rear wall along the extent of the cap and open through the front end of the cap. The spacing of the flute grooves about the cap bore defines a plurality of parallel ribs 38 which, upon insertion of the outlet member neck portion 30 into the cap engage the exterior of the neck portion and mount the cap, coaxially of the outlet member as shown in FIG. 1, for example. The portions of flute grooves 37 which extend along the exterior of the outlet member neck portion define the inlet for water flow from cavity 15 to nozzle assembly chamber 33. The overall water flow area of the inlet to chamber 29 is at least as great as the minimum water flow area of nozzle outlet duct 31. In a preferred capped flow-reversing nozzle assembly, a conically configured projection 39 extends from the front face of cap wall 36 along the axis of the nozzle assembly partially toward the inlet end of the outlet throat.

In order that a number of different water discharge patterns may be produced by shower head 10 at the selection of a user, the shower head includes a mechanism 40 operable by a user for modulating the effective force of water discharged by nozzle assemblies 27. The modulating mechanism of shower head 10 includes a circular plate 41 which is mounted adjacent the front of body 11 for rotation relative to the body about the axis of barrel bore 16. The plate is of somewhat larger diameter than the body and has a rearwardly extending flange 42 which overlaps the extreme front exterior portion of the shower head body as shown in FIG. 1. A plurality of coarse teeth 43 are defined in the circumference of the plate to provide a convenient means by which a user of the shower head may turn the plate, as desired, for adjusting the nature of the effective discharge from the shower head. Also, as shown in FIG. 2, a lug 44 extends radially from the circumference of the plate. The lug may be engaged by a user to adjust the effective discharge from the nozzle as desired.

Figure 4:
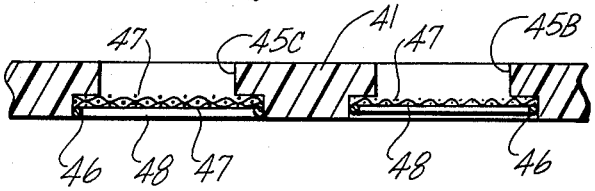
FIG. 4 is a cross-section view taken along line 4—4 in FIG. 2.

Modulating mechanism 40 is arranged so that there are three discrete adjustment states of shower head 10. These adjustment states correspond (a) to no modulation of the effective force or other properties of the discharge pattern produced by nozzle assemblies 27, (b) to a moderate modulation of the force of the discharged water, and (c) to a heavier or more extreme modulation of the force of the water discharged from the two nozzle assemblies of shower head 10. Accordingly, six apertures 45 are formed through plate 41. The apertures are centered on a circle which has its radius equal to the distance between the axis of barrel bore 16 and the axis of the outlet throat of either nozzle assembly 27, the two nozzle assemblies being spaced equidistantly from the barrel axis. Also, apertures 45 preferably are spaced equidistantly apart from each other along this circle, as shown best in FIG. 2. The six holes 45 are functionally associated in diametrically opposed pairs 45A, 45B and 45C. Holes 45A are fully open and when aligned with the respective nozzle assemblies have no effect upon the water emerging from the nozzle assemblies. The rear ends of each of apertures 45B and 45C, on the other hand, are circumferentially recessed at 46 as shown in FIG. 4. A single disc of stainless steel wire mesh screen 47 is disposed in the recess at the rear end of each aperture 45B and is held in the recess by a spring retainer ring 48. Two discs 47 of stainless steel wire mesh screen are held in the recess at the rear end of each aperture 45C by a retainer ring 48.

Preferably, the screen discs associated with apertures 45C are of the same mesh as the screens associated with apertures 45B, the two discs associated with apertures 45C being disposed at approximately 45 degree angles to each other (as indicated in FIG. 2) so that the effective mesh of the screen assembly in apertures 45C is substantially finer than the mesh of the single screen disc associated with each of apertures 45B. When apertures 45B are aligned with nozzle assemblies 27, their effect upon the water emerging from the nozzle assemblies is to reduce the effective force of the water leaving the shower head and to produce an overall discharge effect which is similar to the discharge effect produced when the adjusting member of the shower head shown in U.S. Pat. No. 3,791,584 (such as a Rain Jet RMS 200 shower head) is placed at its intermediate position relative to the body of such a shower head. When apertures 45C are aligned with the nozzle assemblies 27, an even greater force modulating effect is produced, the overall discharge characteristic from shower head 10 in such case being similar to that produced when the adjusting member of a Rain Jet RMS 200 shower head is in its fully extended and fully modulating position.

It will be observed from FIGS. 1 and 2 that when plate 41 of discharge modulating mechanism 40 of shower head 10 is disposed in any position other than one of its three discrete modulating positions, the unapertured portion of plate 41 interferes with the discharge from the nozzle assemblies. Shower head 10 includes a valve assembly 50 which is operatively coupled to the modulating mechanism for interrupting the flow of water to cavity 15 when the modulating mechanism is disposed to be substantially out of any one of its three discrete modulating positions. Accordingly, a generally cylindrical valve member 51 is rotatably disposed within barrel bore 16 and is connected to modulating plate 41 by a key projection 52 which is snugly received in a correspondingly configured recess in the central rear portion of plate 41. The forward end of the valve member is of generally disc-like configuration, and it is from this disc that key projection 52 extends. An O-ring 54 is engaged between the exterior of the valve member and the interior of barrel 12 to seal against leakage of water from the barrel bore to the exterior of the shower head.

Figure 3:
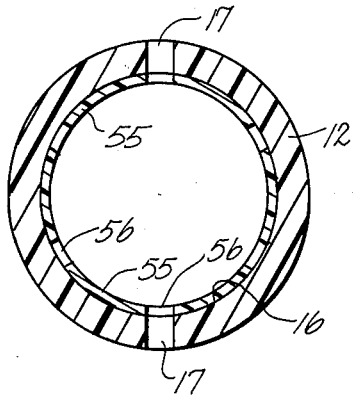
FIG. 3 is a cross-section view taken along line 3—3 in FIG. 1.

Six fingers 55 extend rearwardly from the disc portion of the valve member and make sliding contact with the walls of the barrel bore. The axial extent of fingers 55 is sufficient that the rear ends of the fingers are disposed rearwardly in the bore of the rear ends of slots 17 from the barrel bore to cavity 15. The spacing between the fingers, as shown in FIG. 3, corresponds to the width of each of slots 17 circumferentially of the barrel bore. Accordingly, six openings 56 are provided between adjacent ones of valve fingers 55. The modulating mechanism plate 41 and valve member 51 are angularly related to each other so that, when any one of apertures 45 is aligned with a nozzle assembly 27, diametrically opposed ones of openings 56 are aligned with slots 17, as shown in FIG. 3. When the modulating mechanism is disposed in any position other than one of its three discrete modulating positions, appropriate ones of fingers 55 are moved into position across slots 17 to close off the slots and to interrupt the flow of water from the shower head barrel into cavity 15.

Preferably, valve member 51 is molded of a suitable plastic and, as molded, the fingers of the valve member flare slightly outwardly from each other at their rear ends. Upon insertion of the valve member into barrel 12, the fingers are deformed inwardly from their normal positions; the inherent resilience of the valve member material causes the fingers to be urged outwardly into intimate mating contact with the walls of barrel bore 16. Also, applied water pressure within the barrel bore further serves to urge the fingers into intimate contact with the bore walls, particularly when the valve member is angularly positioned to place the fingers in closure relation to slots 17.

An O-ring 58 is disposed in a recess formed concentric to the axis of valve member 51 in the rear face of modulating plate 41 to bear upon the front face of the shower head body. O-ring 58 functions as a drag brake between the modulating mechanism and the shower head body to provide a suitable resistance force against which the modulating mechanism must be operated and to maintain the modulating mechanism in any desired adjusted position.

Figure 6:
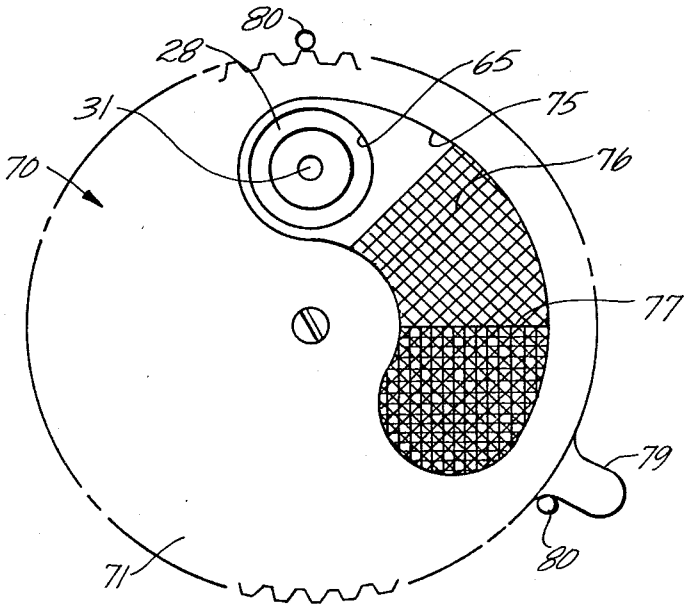
FIG. 6 is a front elevation view taken along line 6—6 in FIG. 5.

A single nozzle shower head 60 is shown in FIGS. 5 and 6 and is the presently preferred shower head according to this invention. A comparison of shower head 60 with shower head 10 (as shown in FIG. 1) will show that shower head 60 includes many of the structural features and relationships which have already been described above concerning shower head 10. Accordingly, many of the reference numbers used in FIGS. 5 and 6 pertain to structural features which have already been described above in the context of shower head 10.

Shower head 60 includes a generally circular hollow body 61 having a front wall 62 and a rear wall 63. An externally threaded, axially bored nipple 64 preferably is formed integral with the body rear wall and extends rearwardly from the rear wall. The rear and outer configuration of the nipple reproduces the rear and outer configuration of barrel 12 of shower head 10 for receipt of a strainer screen 21 and a gasket 22 and for cooperation with a socket ball 23 and ball retainer nut 26.

Figure 7:
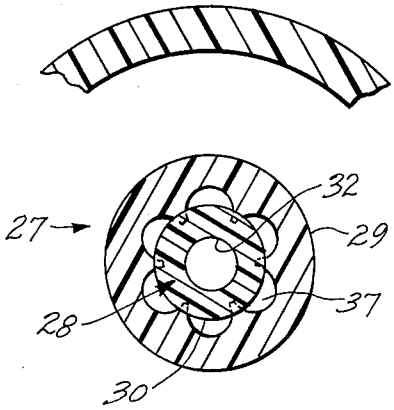
FIG. 7 is a fragmentary cross-sectional elevation view taken along line 7—7 in FIG. 5.

A single opening 65 is formed through body front wall 62 at a location displaced from the axis 66 of the shower head. A nozzle assembly 27 is disposed in a cavity 68 defined in body 61 and receives from the cavity water supplied to the cavity through nipple 64. The forward discharge end of an outlet member 28 of nozzle assembly 27 is engaged in opening 65 in a watertight manner. Preferably the nozzle assembly outlet member and the shower head body are fabricated of plastic, and these components of the shower head are coupled by a solvent bond. In shower head 60, nozzle assembly 27 is in accord with the foregoing description presented relative to FIGS. 1 and 3, the cross-sectional illustration of FIG. 7 being equally as applicable to shower head 60 as it is to shower head 10 as illustrated in FIG. 1. FIG. 7 shows that the inlet to chamber 33 as defined by passages 37 is coaxially aligned with outlet duct throat 32.

A modulating mechanism 70 in shower head 60 includes a circular plate 71 which has a diameter slightly greater than the diameter of body 61. Plate 71 has a rearwardly extending flange 42 which overlies the outer front extremity of the body. The rim of plate 71 is circumferentially contoured to define a plurality of coarse teeth 43 for the purposes previously described. The modulating plate 71 is axially bored to cooperate with the unthreaded portion of a headed mounting axle 73, the rear portion of which is threaded into the front wall 62 of the shower head body along axis 66. An O-ring 74 is engaged circumferentially of the axle between the modulating plate and the body front wall for the same reasons as have been described concerning O-ring 58 of shower head 10.

A single slot aperture 75 is formed through modulating plate 71. As shown in FIG. 6, the slot aperture has its elongate extent wrapped along a circular arc concentric to shower head axis 66. The center line of slot aperture 75 is spaced from axis 66 a distance equal to the spacing of the axis of nozzle assembly 27 from the shower head axis 66. To provide at least three distinctly different modulating effects in shower head 60, including one effect in which the discharge from the nozzle assembly is not modified or modulated, two pieces 76 and 77 of wire mesh screen are disposed in slot aperture 75. Screen piece 76 is the larger of the two pieces and is disposed so that it covers approximately $\frac{2}{3}$ of the areal extent of the slot aperture as shown in FIG. 6; screen 76 is positioned in the slot aperture so that one end of the aperture is entirely unscreened. The other piece 77 of screening is disposed across the slot aperture at the other end of the aperture to cover approximately $\frac{1}{3}$ of the areal extent of the aperture. Preferably, both pieces 76 and 77 of screening are defined by stainless steel wire mesh screen of the same mesh size. Screen 77 is cut so that when it is placed across the slot aperture adjacent to screen 76, the wires of screen 77 are disposed at approximately a 45° angle relative to the wires of screen 76. Preferably, screen pieces 76 and 77 are disposed in a recess 78 (see FIG. 5) formed in the rear face of plate 71 around the margin of the slot aperture. The screen pieces are secured in the recess by suitable retainers.

From an examination of FIG. 6, it will be apparent that there are at least three distinct effective positions of modulating mechanism 70 relative to the body of shower head 60. The unmodulating position of modulating mechanism 70 is shown in FIG. 6 in which the unscreened end of slot aperture 75 is aligned with nozzle assembly 27. The second lightly modulating position is that in which the central portion of the slot aperture, traversed only by screen 76, is aligned with the nozzle assembly. The third distinctive modulating position is a heavily modulating position in which the doubly screened end of slot aperture 75 is aligned with the nozzle assembly. It should be understood, however, that modulating assembly 70 has a wide range of additional operative positions relative to the nozzle assembly, which positions provide modulating effects intermediate the three distinctive modulating positions described above. For example, the modulating mechanism may be operated to cause screen 76 to only partially interact with the water emerging from the nozzle assembly 27.

It will be observed from FIG. 5 that no valve is included in shower head 60 for interrupting the flow of water to nozzle assembly 27 during stages of the operation of modulating mechanism 70. However, suitable stops are provided which cooperate between the modulating mechanism and shower head body 61 for limiting the angular positions of modulating mechanism 70 relative to the body to prevent any of the unapertured portion of plate 71 from being placed in overlying relation to nozzle assembly 27. Accordingly, a radially extending lug 79 extends from the periphery of plate 71 (as shown in FIG. 6) and cooperates with two stop fingers 80 which are mounted to the body 61 and which project into the path of the lug. Preferably, stop fingers 80 are molded integral with the major portion of body 61; where the major portion of the shower head body is fabricated by an injection molding technique, for example, the outlet member of nozzle assembly 27 may conveniently be molded integral with the adjacent portions of the body.

In view of the disclosures of my concurrently filed patent applications, workers skilled in the art to which this invention pertains will readily appreciate that any of the nozzle arrangements described in either of those two applications may be used in the practice of the present invention. All of the different nozzle arrangements and structures described in the concurrently filed applications operate to produce the desired randomly directionally unstable discharge characteristic in liquids discharged by them over a wide range of applied liquid pressures and flow rates. This randomly directionally unstable discharge characteristic is described above in the first paragraph of this portion of this application.

When water emitted by a nozzle assembly in a shower head according to this invention contacts the body of a user of either of shower heads 10 or 60 without modulation by the modulating mechanism of the shower head, the sensed effect is of a massage-like nature which is very similar to the effect produced by a Rain Jet RMS 200 shower head when the adjustment shroud of such a shower head is in its fully retracted position. The effect upon the body of a user of shower head 60 when only screen 76 is disposed fully across the outlet opening of nozzle assembly 27 is very similar to the effect produced when the adjustment shroud of a Rain Jet RMS 200 shower head is in its intermediate position, and the sensed effect on a user of shower head 60 when both screens 76 and 77 are placed adjacent the outlet of nozzle assembly 27 is very similar to the effect obtained by use of a Rain Jet RMS 200 shower head with the adjustment shroud fully extended.

Workers skilled in the art to which this invention pertains will appreciate that the foregoing description has been presented by way of example, with reference to selected shower head structures according to this invention including the presently preferred shower head structure shown in FIGS. 5 and 6. Such workers will appreciate that the foregoing description is not exhaustive of all forms which shower heads according to this invention may take. Such workers will appreciate that modifications, variations and alterations in the structures specifically described above may be practiced without departing from the scope of this invention.

What is claimed is:

1. A shower head comprising a. a body defining therein a cavity and having a front face defining an opening therein, b. means coupled to the body adapting the body to be connected to a source of water for flow of water from the source into the cavity, c. a nozzle disposed in the cavity with a discharge end thereof mounted in alignment with the opening for discharge of water from the cavity only through the nozzle, the nozzle having no moving parts and being arranged to produce a randomly directionally unstable discharge characteristic in water discharged therefrom during use, and d. modulating means mounted to the body operable by a user of the shower head for modulating the effective force of water discharged by the nozzle, the modulating means including a plate disposed externally of the body adjacent a front face thereof, a slot aperture through the plate and disposed in the plate for registry of all portions thereof at different times with the opening in response to movement of the plate relative to the body, and screen means including mesh screening of at least two different effective meshes disposed in only a portion of the slot aperture, the modulating means having a first position in which the unscreened portion of the slot aperture registers with the opening and in which alignment of the screened portion of the slot aperture with the opening is a modulating position of the modulating means relative to the body.

2. A shower head according to claim 1 wherein the screen means are disposed in the slot aperture so that one end portion of the aperture is unscreened, a central portion of the aperture is screened by screening of one effective mesh, and the other end portion is screened by screening of a second effective mesh.

3. A shower head comprising a. a body defining therein a cavity and having a front face defining an opening therein, b. means coupled to the body adapting the body to be connected to a source of water for flow of water from the source into the cavity, c. a nozzle disposed in the cavity with a discharge end thereof mounted in alignment with the opening for discharge of water from the cavity only through the nozzle, the nozzle having no moving parts and being arranged to produce a randomly directionally unstable discharge characteristic in water discharged therefrom during use, and d. modulating means mounted to the body operable by a user of the shower head for modulating the effective force of water discharged by the nozzle, the modulating means including a plate disposed externally of the body adjacent a front face thereof, aperture means defined through the plate for movement into registry with the opening, the aperture means comprising three discrete apertures at locations in the plate arranged so that each aperture is registrable with the opening at different times in response to movement of the plate relative to the body, screen means including mesh screening of at least two different effective meshes disposed in only a portion of the aperture means, and e. valve means in the body and coupled to the plate for operation in response to movement of the plate relative to the body for shutting off flow of water from the source into the cavity when the plate is disposed to place no one of the apertures in alignment with the opening.

4. A shower head comprising a. a body defining therein a cavity and having a front face defining an opening therein, b. means coupled to the body adapting the body to be connected to a source of water for flow of water from the source into the cavity, c. a nozzle disposed in the cavity with a discharge end thereof mounted in alignment with the opening for discharge of water from the cavity only through the nozzle, the nozzle having no moving parts and being arranged to produce a randomly directionally unstable discharge characteristic in water discharged therefrom during use, and d. modulating means mounted to the body operable by a user of the shower head for modulating the effective force of water discharged by the nozzle, the modulating means including a plate disposed externally of the body adjacent a front face thereof and angularly movable relative to the body, the modulating means having plural operating positions relative to the body including a first position in which the nozzle discharge is unmodulated, and e. valve means in the body coupled to the modulating means for operation in response to angular movement of the modulating means for preventing flow of water from the source into the cavity when the modulating means is in a position other than one of its operating positions.

5. A shower head comprising a. a body defining therein a cavity and a liquid inlet thereto, and having a front face defining an opening therein, b. means coupled to the body adapting the body to be connected to a source of water for flow of water from the source through the liquid inlet into the cavity, c. a nozzle disposed in the cavity with a discharge end thereof mounted in alignment with the opening for discharge of water from the cavity only through the nozzle, the nozzle having no moving parts and being arranged to produce a randomly directionally unstable discharge characteristic in water discharged therefrom during use, the nozzle defining a liquid outlet duct from the cavity to the exterior of the body, the liquid flow area of the cavity inlet being at least as great as the minimum liquid flow area of the outlet duct, the outlet duct having a straight throat portion of constant diameter communicating from the cavity to a flared second portion of the duct, the duct throat portion having a ratio of length to diameter in the range of from about 4 to about 18, the diameter of the duct second portion increasing proceeding along the duct from the cavity from a diameter equal to that of the duct throat portion, the angle of flare of the duct second portion relative to the axis of the throat at the intersection of the duct throat and second portions being at least 2° and no greater than 6°, and d. modulating means mounted to the body operable by a user of the shower head for modulating the effective force of water discharged by the nozzle, the modulating means having plural operating positions relative to the body including a first position in which the nozzle discharge is unmodulated.

6. A shower head comprising a. a body defining therein a cavity and having a front face defining an opening therein, b. means coupled to the body adapting the body to be connected to a source of water for flow of water from the source into the cavity, c. a nozzle disposed in the cavity with a discharge end thereof mounted in alignment with the opening for discharge of water from the cavity only through the nozzle, the nozzle having no moving parts and being arranged to produce a randomly directionally unstable discharge characteristic in water discharged therefrom during use, the nozzle defining a liquid outlet duct from the cavity to the exterior of the body, the outlet duct having a straight throat portion of constant diameter communicating from the cavity to a flared second portion of the duct, the duct throat portion having a ratio of length to diameter in the range of from about 4 to about 18, the angle of flare of the duct second portion relative to the axis of the duct throat portion at the end of the duct second portion remote from the duct throat portion being greater than 6°, the duct throat and second portions being coupled by a flared transition section in which the angle of flare of the duct is not greater than 6°, the diameter of the inlet end of the duct transition section and the outlet end of the duct throat portion being equal, and d. modulating means mounted to the body operable by a user of the shower head for modulating the effective force of water discharged by the nozzle.

7. A shower head comprising a. a body defining therein a cavity and having a front face defining an opening therein, b. means coupled to the body adapting the body to be connected to a source of water for flow of water from the source into the cavity, c. a nozzle disposed in the cavity with a discharge end thereof mounted in alignment with the opening for discharge of water from the cavity only through the nozzle, the nozzle having no moving parts and being arranged to produce a randomly directionally unstable discharge characteristic in water discharged therefrom during use, the nozzle comprising a body defining therein a chamber having a liquid inlet thereinto from the cavity and a liquid outlet duct therefrom to the exterior of the nozzle body, the liquid flow area of the inlet to the chamber being at least as great as the minimum liquid flow area of the outlet duct, the liquid inlet to the chamber being defined for flow of liquid into the chamber in a direction substantially opposite to the direction of liquid flow from the chamber through the outlet duct, the chamber being defined cooperatively with the inlet and outlet ducts for substantially linear flow of liquid through the outlet duct during operation of the nozzle, the outlet duct having a straight throat portion of constant diameter communicating from the chamber to a flared second portion of the duct, the duct throat portion having a ratio of length to diameter in the range from about $\frac{1}{3}$ to about 18, the diameter of the duct second portion increasing proceeding along the duct from the chamber from a diameter equal to that of the duct throat portion, the angle of flare of the duct second portion relative to the axis of the throat at the intersection of the duct throat and second portions being at least 2° and no greater than 6°, and d. modulating means mounted to the body operable by a user of the shower head for modulating the effective force of water discharged by the nozzle.

8. A shower head according to claim 7 wherein the nozzle throat length to diameter ratio is in the range of from about 1 to about 7.

9. A shower head according to claim 7 wherein the nozzle throat length to diameter ratio is in the range of from about 1 to about 4.

10. A shower head according to claim 7 wherein the chamber has a wall spaced from the inlet end of the outlet throat, and including a projection extending from the wall along the throat axis toward the throat inlet.

11. A shower head according to claim 7 wherein the nozzle outlet throat is defined through a tubular neck, and the inlet to the chamber is defined along the exterior of the neck for flow of liquid into the chamber along a path substantially parallel to the outlet throat.

12. A shower head according to claim 7 wherein the chamber is defined within a cap member, and the neck extends partially into the cap member.

13. A shower head according to claim 7 wherein the nozzle inlet and the nozzle outlet duct are coaxially aligned.

14. A shower head comprising a. a body defining therein a cavity and having a front face defining an opening therein, b. means coupled to the body adapting the body to be connected to a source of water for flow of water from the source into the cavity, c. a nozzle disposed in the cavity with a discharge end thereof mounted in alignment with the opening for discharge of water from the cavity only through the nozzle, the nozzle having no moving parts and being arranged to produce a randomly directionally unstable discharge characteristic in water discharged therefrom during use, the nozzle comprising a body defining therein a chamber having a liquid inlet thereinto from the cavity and a liquid outlet duct therefrom to the exterior of the nozzle body, the liquid flow area of the inlet to the chamber being at least as great as the minimum liquid flow area of the outlet duct, the liquid inlet to the chamber being defined for flow of liquid into the chamber in a direction substantially opposite to the direction of liquid flow from the chamber to the outlet duct, the chamber being defined cooperatively with the inlet and the outlet duct for substantially linear flow of liquid through the outlet duct during operation of the nozzle, the outlet duct having a straight throat portion of constant diameter communicating from the chamber to a flared second portion of the duct, the duct throat portion having a ratio of length to diameter in the range of from about $\frac{1}{3}$ to about 18, the diameter of the duct second portion increasing proceeding along the duct from the chamber from a diameter equal to that of the duct throat portion, the angle of flare of the duct second portion relative to the axis of the duct throat portion at the end of the duct second portion remote from the duct throat portion being greater than 6°, the duct throat and second portions being coupled by a flared transition section in which the angle of flare of the duct is not greater than 6°, the diameter of the inlet end of the duct transition section and the outlet end of the duct throat portion being equal, and d. modulating means mounted to the body operable by a user of the shower head for modulating the effective force of water discharged by the nozzle.

* * * * *

UNITED STATES PATENT AND TRADEMARK OFFICE

CERTIFICATE OF CORRECTION

PATENT NO. : 4,055,301

DATED : October 25, 1977

INVENTOR(S) : John O. Hruby, Jr.

It is certified that error appears in the above-identified patent and that said Letters Patent are hereby corrected as shown below:

Abstract, line 11, for "fo" read -- for --.
Column 14, line 27, after "and" insert -- the --;
line 60, for "7" read -- 11 --.

Signed and Sealed this

*Fourteenth* Day of *March 1978*

[SEAL]

*Attest:*

RUTH C. MASON
*Attesting Officer*

LUTRELLE F. PARKER
*Acting Commissioner of Patents and Trademarks*